US010050381B2

(12) United States Patent
Wolter et al.

(10) Patent No.: US 10,050,381 B2
(45) Date of Patent: Aug. 14, 2018

(54) PLUG CONNECTOR HAVING HOUSING PARTS HAVING CHANNELS WITH SPRING TONGUES FOR FIXING PLUG CONTACTS WITHIN THE CHANNELS

(71) Applicant: Kostal Kontakt Systeme GmbH, Luedenscheid (DE)

(72) Inventors: Martin Wolter, Dortmund (DE); Uwe Raschke, Hagen (DE); Guido Eberhardt, Hagen (DE); Alexander Koch, Luedenscheid (DE); Christian Jaworek, Meschede (DE)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 0 days.

(21) Appl. No.: 15/852,666

(22) Filed: Dec. 22, 2017

(65) Prior Publication Data

US 2018/0123289 A1 May 3, 2018

Related U.S. Application Data

(63) Continuation of application No. PCT/EP2016/066431, filed on Jul. 11, 2016.

(30) Foreign Application Priority Data

Jul. 13, 2015 (DE) ..... 10 2015 009 039

(51) Int. Cl.
*H01R 13/514* (2006.01)
*H01R 13/629* (2006.01)
(Continued)

(52) U.S. Cl.
CPC ... *H01R 13/62927* (2013.01); *H01R 13/4362* (2013.01); *H01R 13/514* (2013.01); *H01R 13/6272* (2013.01)

(58) Field of Classification Search
CPC ..... H01R 13/6271; H01R 13/4226; H01R 13/514; H01R 13/4362; H01R 13/6272; H01R 13/62927
(Continued)

(56) References Cited

U.S. PATENT DOCUMENTS 5,879,196 A * 3/1999 Lee ..... H01R 13/504 439/604
6,234,826 B1 * 5/2001 Wilber ..... H01R 13/4368 439/352
(Continued)

FOREIGN PATENT DOCUMENTS

DE 29804419 U1 5/1998
DE 102007026582 B3 12/2008
(Continued)

OTHER PUBLICATIONS

The International Bureau of WIPO, International Preliminary Report on Patentability for International Application No. PCT/EP2016/066431, dated Jan. 16, 2018.
(Continued)

*Primary Examiner* — Chandrika Prasad
(74) *Attorney, Agent, or Firm* — Brooks Kushman P.C.

(57) ABSTRACT

A plug connector part includes a housing having first and second housing parts. The housing parts are joined together parallel to a plug contact insertion direction. The housing parts have lateral surfaces which face one another when the housing parts are joined together. The housing parts have parallel grooves at their lateral surfaces. The grooves form plug contact receiving channels when the housing parts are joined together. The plug contacts have lances which engage projections of the receiving channels when the plug contacts are fully received within the receiving channels. The first housing part includes spring tongues along the grooves of the first housing part for fixing the plug contacts within the
(Continued)

receiving channels. The spring tongues have tab-like sections which extend into the receiving channels and engage the plug contacts to fix the plug contacts within the receiving channels in a form-fit manner.

6 Claims, 9 Drawing Sheets

(51) Int. Cl.
*H01R 13/627* (2006.01)
*H01R 13/436* (2006.01)

(58) Field of Classification Search
USPC ..... 439/352, 357, 595, 701, 752, 310
See application file for complete search history.

(56) References Cited

U.S. PATENT DOCUMENTS

| | | | | |
|---|---|---|---|---|
| 6,595,806 | B2 * | 7/2003 | Mochizuki | H01R 13/506 439/701 |
| 6,893,295 | B1 * | 5/2005 | Lloyd | H01R 12/772 439/607.05 |
| 7,625,251 | B2 * | 12/2009 | Martin | H01R 13/4223 439/752 |
| 7,892,048 | B2 * | 2/2011 | Shi | H01R 13/4367 439/752 |
| 2003/0008567 | A1 | 1/2003 | Mochizuki | |
| 2004/0253880 | A1 * | 12/2004 | Correll | H01R 13/4367 439/752 |
| 2009/0081908 | A1 | 3/2009 | Martin et al. | |
| 2011/0294324 | A1 | 12/2011 | Bihrer et al. | |
| 2013/0203299 | A1 * | 8/2013 | Wilkner | H01R 13/4361 439/701 |
| 2015/0038022 | A1 * | 2/2015 | Kataoka | H01R 13/426 439/752 |

FOREIGN PATENT DOCUMENTS

| | | | |
|---|---|---|---|
| DE | 102008052822 | A1 | 4/2010 |
| EP | 0854543 | A2 | 7/1998 |
| EP | 0951100 | A2 | 10/1999 |
| EP | 1113535 | A2 | 7/2001 |
| EP | 1912290 | A1 | 4/2008 |
| JP | H1021986 | A | 1/1998 |
| JP | H11185860 | A | 7/1999 |

OTHER PUBLICATIONS

European Patent Office, International Search Report for the corresponding International Application No. PCT/EP2016/066431, dated Sep. 23, 2016.

German Patent and Trademark Office, German Search Report for the corresponding German Patent Application No. 10 2015 009 039.9 dated May 13, 2016.

* cited by examiner

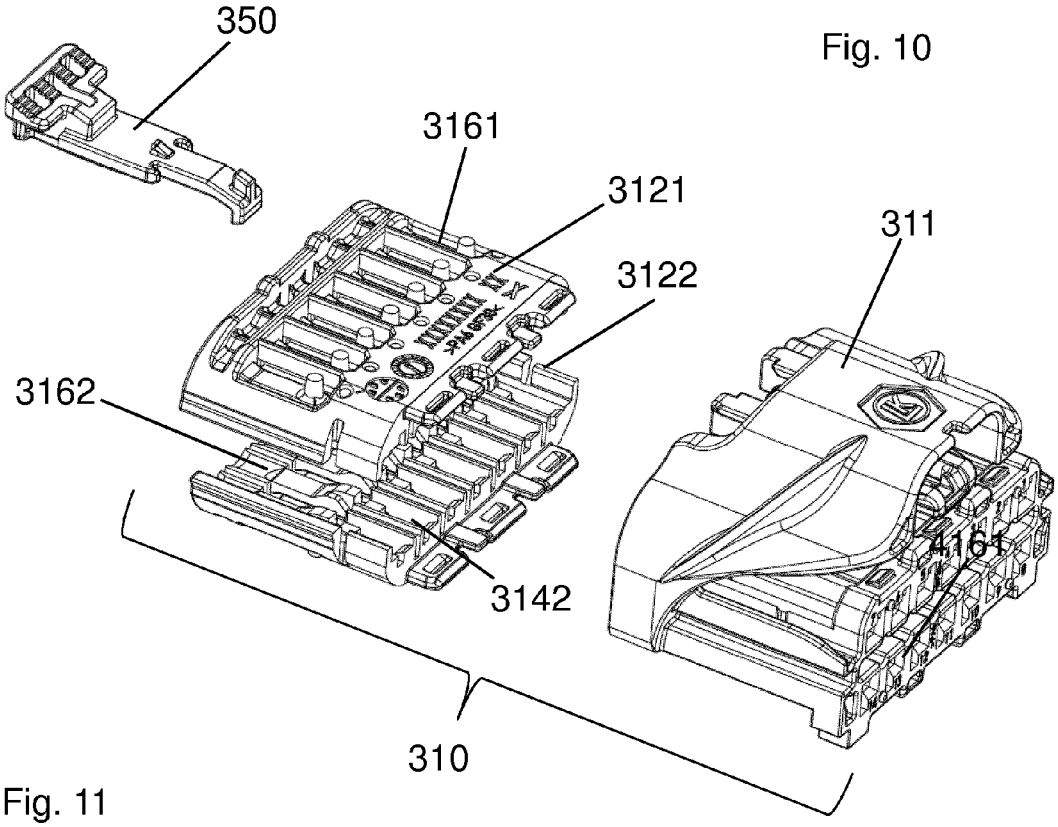
Fig. 10
Fig. 11
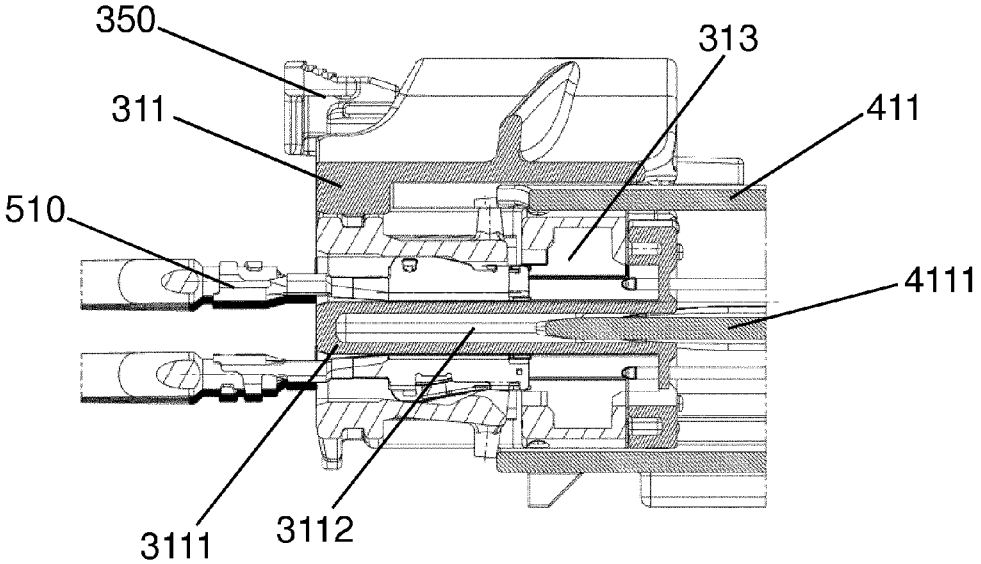

PLUG CONNECTOR HAVING HOUSING PARTS HAVING CHANNELS WITH SPRING TONGUES FOR FIXING PLUG CONTACTS WITHIN THE CHANNELS

CROSS-REFERENCE TO RELATED APPLICATIONS

This application is a continuation of International Application No. PCT/EP2016/066431, published in German, with an International filing date of Jul. 11, 2016, which claims priority to DE 10 2015 009 039.9, filed Jul. 13, 2015; the disclosures of which are hereby incorporated in their entirety by reference herein.

TECHNICAL FIELD

The present invention relates to a multipole electrical plug connector part having a housing made up of at least two housing parts that are joined together parallel to a provided insertion direction, wherein at their lateral surfaces that face one another when the housing parts are joined together, the housing parts each have integrally formed parallel grooves that form parallel receiving channels for receiving plug contacts after the housing parts have been joined together, wherein the plug contacts have integrally formed elastic elements that engage with projections of the receiving channels, and sections of at least one housing part fix the position of the plug contacts within the receiving channels in a form-fit manner. The present invention further relates to a plug connector arrangement made up of two such plug connector parts.

BACKGROUND

DE 298 04 419 U1 describes an electrical plug connector part having a housing that is divided lengthwise. The housing is made up of two support body parts. Each support body part has multiple molded-in, parallel, channel-like plug contact receptacles. The support body parts are lockable against one another. Integrally formed blocking elements on each support body part engage with locking openings in the respective other support body part, thus locking plug contacts in the plug contact receptacles in a form-fit manner.

It is disadvantageous that assembling the housing by locking the support body parts cannot take place until after all plug contacts have been inserted. Since otherwise, the blocking elements that engage with the plug contact receptacles prevent insertion of the plug contacts into the plug contact receptacles. Thus, the housing of the plug connector part cannot be pre-assembled without the plug contacts inserted.

In DE 10 2008 052 822 A1 (corresponding to U.S. Publication No. 2011/0294324), FIGS. 19 through 24 thereof illustrate a plug connector part having a housing made up of two housing parts designed as half-shells. The half-shells are manufacturable as identical parts. The half shells have integrally formed parallel grooves on their joinable contact surfaces in the longitudinal direction. When the half-shells are joined together, the grooves form respective channel-like receiving spaces extending in parallel through the housing in the longitudinal direction. When the plug connector part is completely assembled, a plug contact and a section of a feed line (i.e., wire, cable, etc.) connected to the plug contact are inserted into each of the receiving spaces.

The plug contacts are each held in a form-fit manner within the receiving spaces by a ring-shaped projection. The feed lines are fixed in the receiving spaces by integrally formed strain relief elements. Due to this design, the plug contacts must be attached to one of the half-shells prior to joining the half-shells. The joining of the half-shells may take place by adhesive bonding or ultrasonic welding. Thus, here as well, the plug contacts together with their feed lines are already fixedly pre-mounted on the housing of the plug connector part after the housing parts are joined.

For many applications, pre-mounting the feed lines on a plug connector is disadvantageous and therefore is not desirable. If, for example, during laying of cables in a motor vehicle the connecting lines (i.e., wires, cables, etc.) of various devices are to be led to a single multipole plug connector, then it is disadvantageous when the connecting lines are already fixedly connected to the plug connector. It is disadvantageous since, in this case, either the cabling must be laid starting from the plug connector, or in each case additional line connections must be established between device feed lines and the connecting lines of the plug connector.

Also known are plug connector housings with circumferentially closed receiving channels. The receiving channels are initially empty. Push-on sleeves connected to feed lines are inserted into the receiving channels using an elastic detent element (lance). The lance is then held in the receiving channels in a locking manner. DE 298 04 419 U1, cited above, describes this type of plug connector housing with molded-in channels. Forming channels is relatively complicated in injection molding since producing detent elements in the receiving channels require complex slider geometries in the injection mold. Due to the high costs of such a mold and the relatively long cycle times through the complicated injection molding operation, the plug connectors manufactured in this way are quite costly.

SUMMARY

An object is a multipole plug connector part that is particularly easy and cost-effective to manufacture and whose housing may be completely pre-assembled prior to insertion of plug contacts into the plug connector part.

In carrying out at least one of the above and/or other objects, a plug connector part is provided. The plug connector part includes a housing having a first housing part and a second housing part. The housing parts are joined together parallel to a plug contact insertion direction. The housing parts have lateral surfaces which face one another when the housing parts are joined together. The housing parts have integrally formed parallel grooves at their lateral surfaces. The grooves form parallel receiving channels when the housing parts are joined together. The receiving channels are to receive plug contacts. Each receiving channel includes a projection.

The plug connector part further includes plug contacts having integrally formed lances. The lances engage the projections of the receiving channels when the plug contacts are fully received within the receiving channels. The first housing part includes spring tongues along the grooves of the first housing part for fixing the plug contacts within the receiving channels. The spring tongues have tab-like sections which extend into the receiving channels and engage the plug contacts to fix the plug contacts within the receiving channels in a form-fit manner.

The spring tongues may have integrally formed locking cams that are deflectable beyond an outer surface of the first housing part.

Further, in carrying out at least one of the above and/or other objects, a plug connector assembly having two such plug connector parts is provided. The two plug connector parts are joinable to form the assembled plug connector assembly.

An embodiment provides a multipole electric plug connector part having a housing that includes at least two housing parts. The housing parts are joinable together parallel to a provided plug-in direction to form the housing. The housing parts have lateral faces which face one another when the housing parts are joined together. The lateral faces of the housing parts have integrally formed parallel grooves. The grooves form parallel receiving channels when the housing parts have been joined together. The channels are for receiving plug contacts.

The plug contacts have integrally formed elastic elements. The elastic elements latch onto projections of the receiving channels when the plug contacts are fully inserted into the receiving channels. Spring tongues are molded into at least one of the housing parts at the edge of the receiving channels. Tab-like sections of the spring tongues fix the position of the plug contacts within the receiving channels in a form-fitting manner.

Another embodiment provides a plug connector arrangement having two such multipole electric plug connector parts.

In embodiments, tab-like sections for fixing the plug contacts in a form-fit manner within the receiving channels are situated on spring tongues that are molded into a housing part at the edge of the receiving channels.

In embodiments, plug connector parts are formed from housing parts. The housing parts have a half-shell design and are particularly easy and cost-effective to manufacture. The housing parts after being joined allow subsequent fitting of the completely assembled housing with electrical contact elements.

In this regard, it is advantageous that the individual housing parts have no circumferentially closed receiving channels. Instead, circumferentially closed receiving channels are formed only after assembly. No enclosed cavities are provided on the individual half shell-like housing parts. Consequently, no injection molds having complicated shapes are necessary and manufacture of the housing parts may take place particularly easily and quickly using simple, economical molds.

Due to the spring tongues that are molded into the wall of at least one housing part, the plug contacts may be easily inserted into the completely assembled plug connector part. Therefore, the housing of the plug connector part may be completely pre-assembled before the plug contacts are inserted. It is thus advantageously possible for plug contacts to be added to the plug connector part together with connecting lines at the intended place of use.

In embodiments, integrally formed locking elements, for example in the form of locking cams, are on the outer side of the spring tongues. As the result of such locking elements, on the one hand, plug connector parts having incompletely inserted plug contacts cannot be electrically connected to one another and assembled to form a plug connector arrangement. On the other hand, for plug connector parts that are already joined together and form an assembled plug connector arrangement, the locking elements prevent subsequent addition of plug contacts to the plug connector parts. Both factors are advantageous for increasing electrical safety.

In embodiments, plug connector parts may be implemented which have two parallel rows of receiving channels. These are made up of three mutually connected housing parts. In each case, two of the housing parts in direct contact with one another form a row of receiving channels.

BRIEF DESCRIPTION OF THE DRAWINGS

Advantageous exemplary embodiments of the present invention are illustrated and explained with reference to the drawings, which include the following:

FIG. 10 illustrates the housing parts of the housing of the first plug connector part of the second plug connector arrangement; and FIG. 11 illustrates a sectional view of a portion of the second plug connector arrangement.

DETAILED DESCRIPTION

Detailed embodiments of the present invention are disclosed herein; however, it is to be understood that the disclosed embodiments are merely exemplary of the present invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
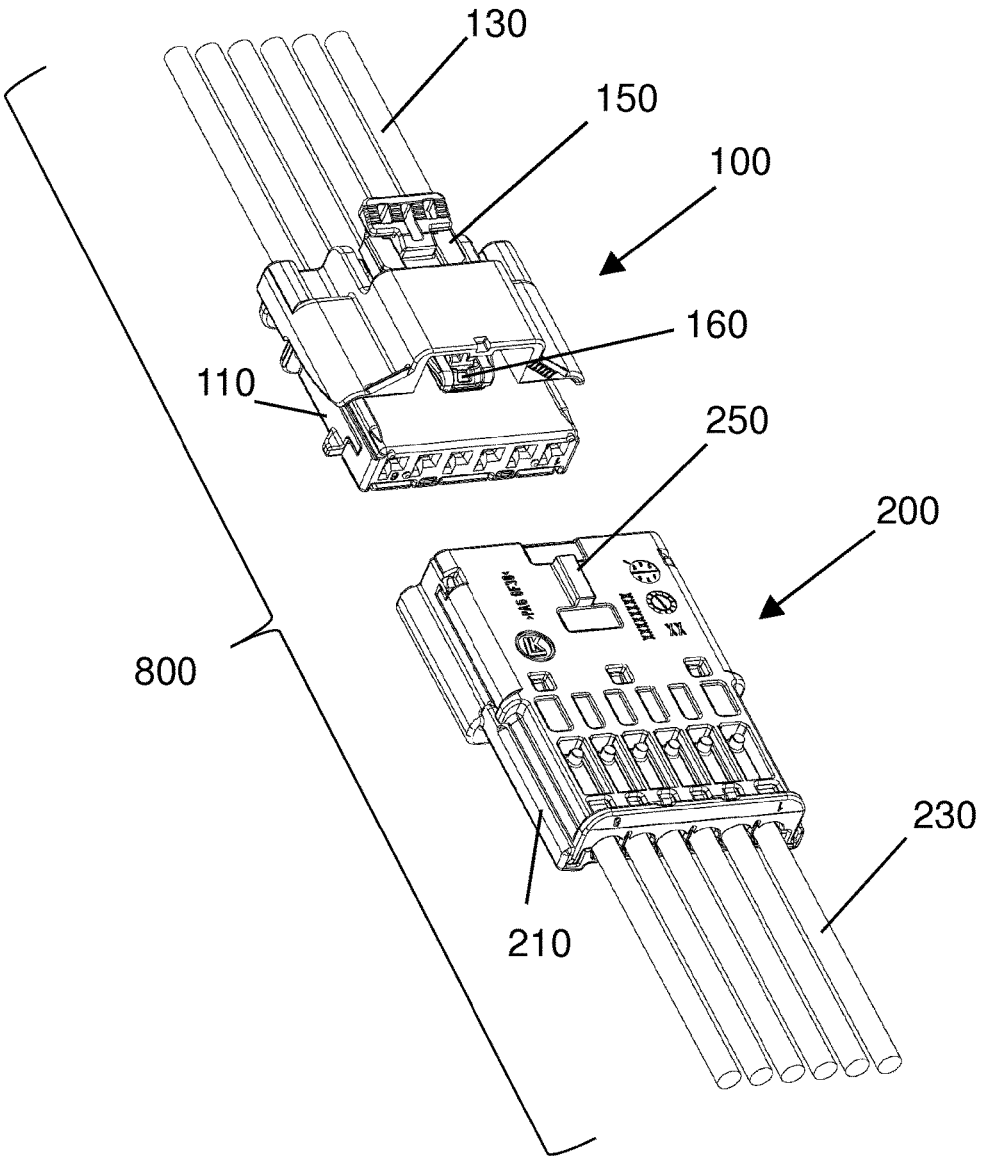
FIG. 1 illustrates a first multipole (i.e., multipolar) electric plug connector arrangement having a first multipole plug connector part and a second multipole plug connector part, the first and second plug connector parts being unconnected in FIG. 1.

FIG. 1 illustrates a first multipole (i.e., multipolar) electrical plug connector arrangement 800. First plug connector arrangement 800 includes a first multipole plug connector part 100 and a second multipole plug connector part 200. First plug connector part 100 and second plug connector part 200 are unconnected in FIG. 1. As an example, first plug connector arrangement 800 has a six-pole design. As such, six connecting lines 130 are guided into the interior of first plug connector part 100 and six connecting lines 230 are guided into the interior of second plug connector part 200.

First plug connector part 100 includes a first housing 110 and second plug connector part 200 includes a second housing 210. Connecting lines 130 guided into the interior of first plug connector part 100 are guided inside first housing 110 and are connected to electrical plug contacts (not shown in FIG. 1). Connecting lines 230 guided into the interior of second plug connector part 200 are guided inside second housing 210 and are connected to the electrical plug contacts (not shown in FIG. 1).

First housing 110 of first plug connector part 100 includes a detent arm 160 resiliently situated on an outer side thereof. A displaceable connector position assurance ("CPA") bar 150 is attached to first housing 110 by being affixed to housing 110. Second housing 210 of second plug connector part 200 includes a projection 250 mounted therein. Detent arm 160 may lock with projection 250 when plug connector parts 100 and 200 are joined together. This detent connection when plug connector parts 100 and 200 are joined together is secured against disconnection by CPA bar 150.

Figure 2:
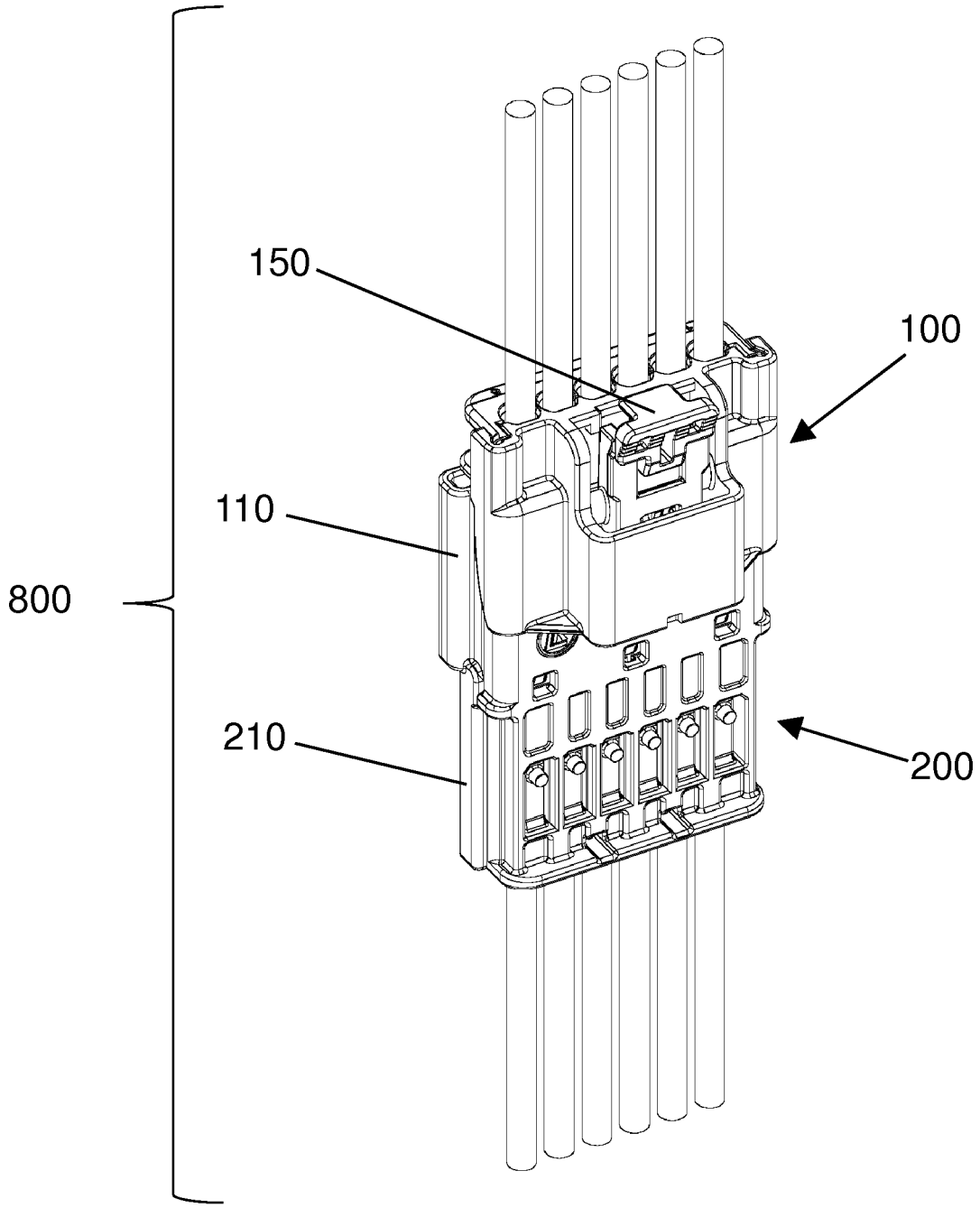
FIG. 2 illustrates the first plug connector arrangement with the first and second plug connector parts being mutually connected.

FIG. 2 illustrates plug connector arrangement 800 with joined-together plug connector parts 100 and 200. The electrical plug contacts are connected to one another inside first housing 110 of first plug connector part 100 and second housing 210 of second plug connector part 200. Housings 110 and 210 are locked together mechanically by detent arm 160 extending over projection 250 (concealed in FIG. 2). The displaced CPA bar 150 additionally secures the detent connection against disconnection. CPA bar 150 may be moved from the position illustrated in FIG. 2 by manual actuation to separate plug connector parts 100 and 200.

Figure 3:
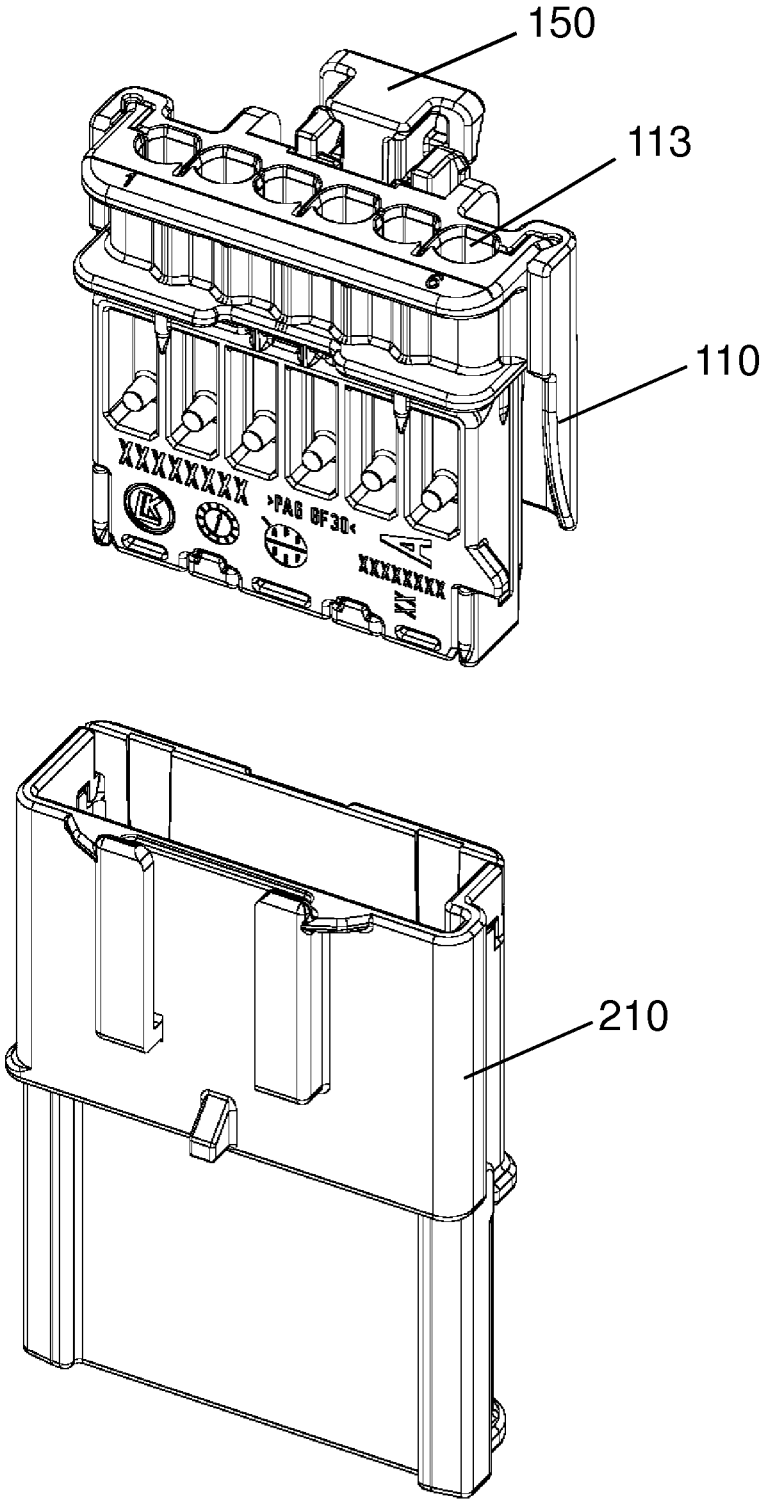
FIG. 3 illustrates the housing of the first plug connector part and the housing of the second plug connector part.
Figure 4:
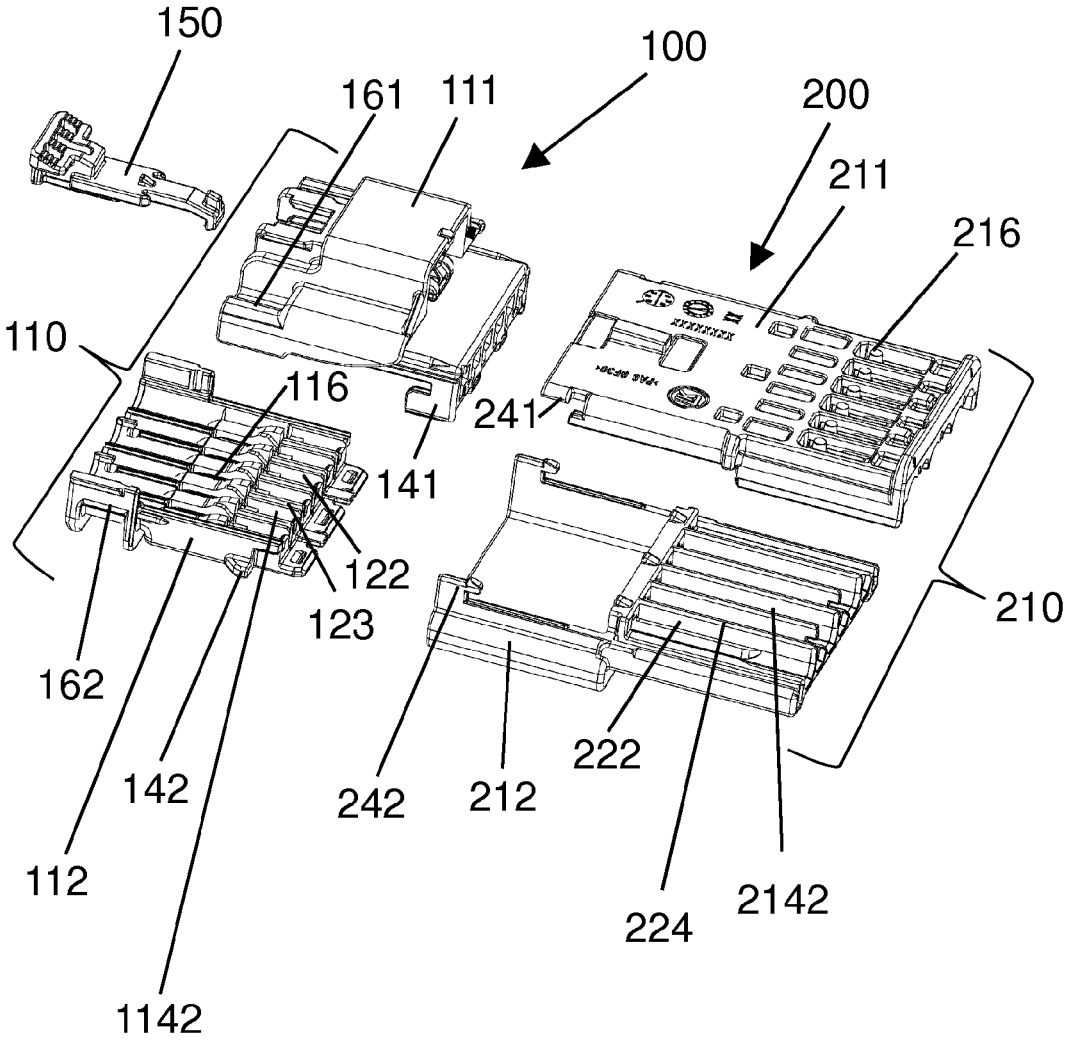
FIG. 4 illustrates a first view of the housing parts of the housing of the first plug connector part and the housing parts of the housing of the second plug connector part.

FIG. 3 illustrates first housing 110 of first plug connector part 100 and second housing 210 of second plug connector part 200 without electrical components such as connecting lines and plug contacts. As illustrated in FIG. 4, each of housings 110 and 210, apart from CPA bar 150, is made up of two housing parts, respectively. Particularly, first housing 110 includes a first housing part 111 and a second housing part 112; and second housing 210 includes a first housing part 211 and a second housing part 212. Housing parts 111 and 112 of first housing 110 are connected to one another in a form-fit manner by hook connecting elements 141 and 142 (e.g., hook fasteners) and detent connecting elements 161 and 162 (e.g., latches). Housing parts 211 and 212 of second housing 210 are connected to one another in a form-fit manner by hook connecting elements 241 and 242.

Figure 5:
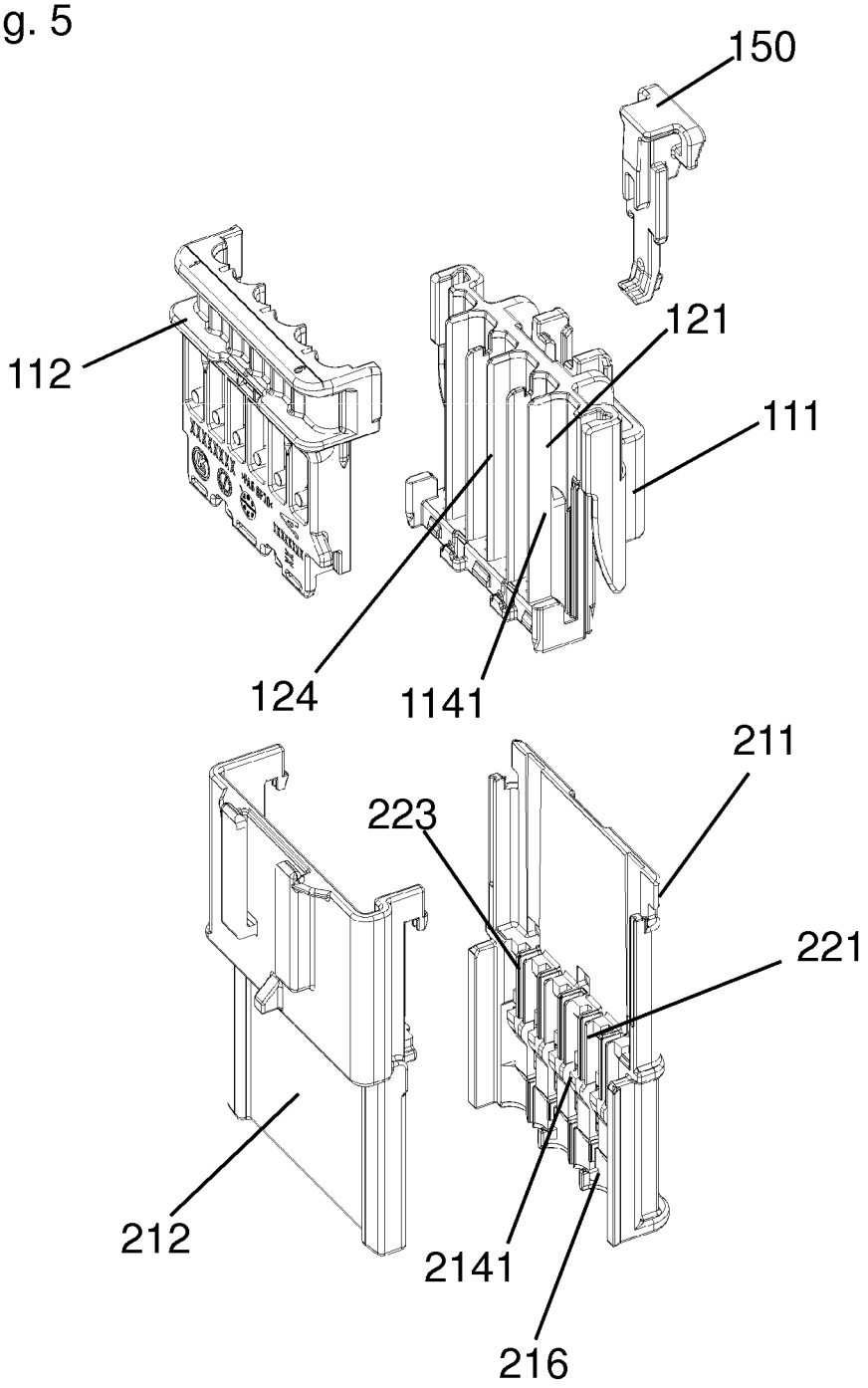
FIG. 5 illustrates a second view of the housing parts of the housing of the first plug connector part and the housing parts of the housing of the second plug connector part.

FIG. 5 illustrates housing parts 111 and 112 of first housing 110 and housing parts 211 and 212 of second housing 210 from another perspective. The front and rear sides of housing parts 111 and 112 and housing parts 211 and 212 concealed in FIG. 4 are discernible in FIG. 5. Viewing FIGS. 4 and 5 together reveals that housing parts 111 and 112, which are connectable to form first housing 110, on their mutually facing lateral surfaces have integrally formed parallel grooves 1141 and 1142. When housing parts 111 and 112 are assembled together, grooves 1141 and 1142 form parallel receiving channels 113. Receiving channels 113 are illustrated in FIG. 3 on first housing 110, in the form of tubular cavities having a circular, oval, or polygonal cross-sectional area, after housing parts 111 and 112 are joined together. Similarly, housing parts 211 and 212, which are connectable to form second housing 210, on their mutually facing lateral surfaces have integrally formed parallel grooves 2141 and 2142. When housing parts 211 and 212 are assembled together, grooves 2141 and 2142 form parallel receiving channels 113.

Figure 6:
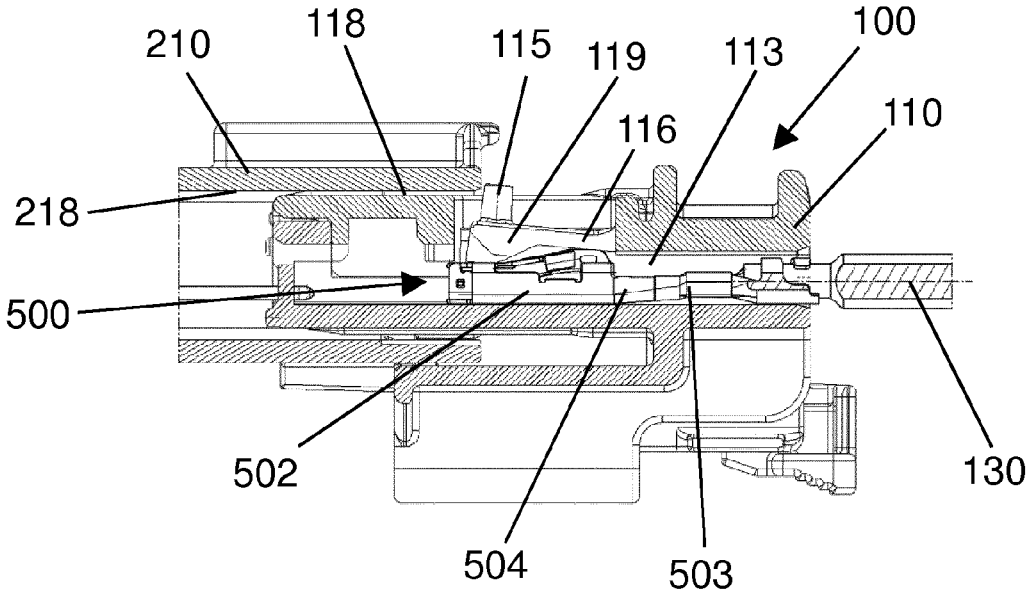
FIG. 6 illustrates a sectional view of the first plug connector part and the second plug connector part in which the first plug connector part is partially inserted into the second plug connector part, but is not yet completely connected to the second plug connector part, and in which a plug contact is inserted into a receiving channel of the first plug connector part, but has not yet reached its intended installation position within the first plug connector part.
Figure 7:
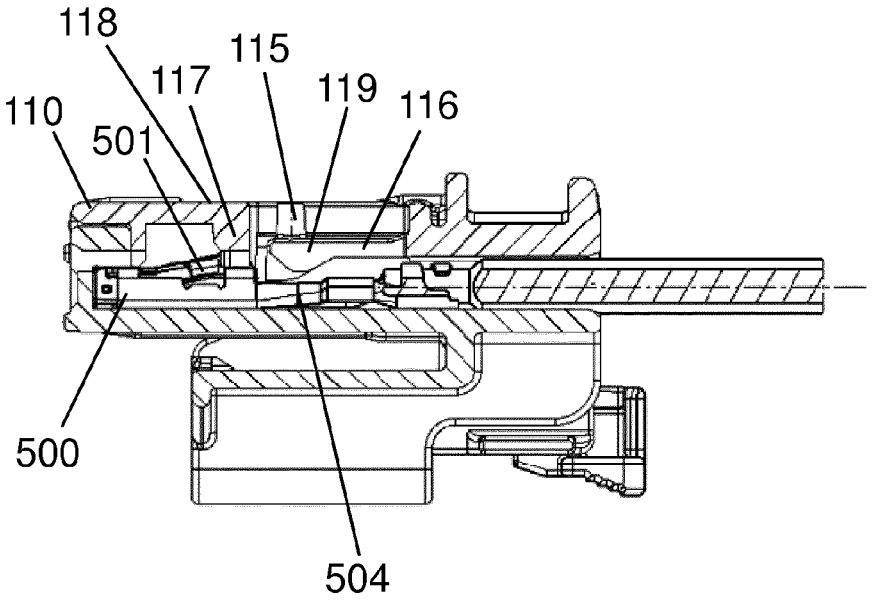
FIG. 7 illustrates a sectional view of the first plug connector part in which the plug contact inserted into the receiving channel of the first plug connector part has reached its intended installation position within the first plug connector part.

Elastic spring tongues 116 are formed in the walls of second housing part 112 of first housing 210 along grooves 1142 of second housing part 112. Elastic spring tongues 116 are provided for fixing plug contacts 500 to first housing 110. Fixing a plug contact 500 by means of a spring tongue 116 is illustrated in FIGS. 6 and 7 on first plug connector part 100, by way of example. Similarly, elastic spring tongues 216 are formed in the walls of first housing part 211 along grooves 2141 of first housing part 211. Elastic spring tongues 116 are provided for fixing plug contacts 500 to second housing 210.

The top edges of webs 121 and 122, which laterally delimit parallel grooves 1141 and 1142 of housing parts 111 and 112 of first housing 110, have molded-in grooves 123 on second housing part 112. Springs 124, which fit into molded-in grooves 123, are molded onto the complementary first housing part 111. Webs 121 and 122 thus form tongue-and-groove connections with one another when housing parts 111 and 112 are joined together. This allows particularly simple and accurately fitting assembly of housing parts 111 and 112 and precise, stable formation of receiving channels 113 of first housing 110.

Similarly, the top edges of webs 221 and 222, which laterally delimit grooves 2141 and 2142 of housing parts 211 and 212 of second housing 210, have molded-in grooves 223 on first housing part 211. Springs 224, which fit into molded-in grooves 223, are molded onto the complementary second housing part 212. Webs 221 and 222 thus form tongue-and-groove connections with one another when housing parts 211 and 212 are joined together. This allows particularly simple and accurately fitting assembly of housing parts 211 and 212 and precise, stable formation of receiving channels 113 of second housing 210.

FIGS. 6 and 7 each illustrate sectional views of the fastening of plug contacts 500 in first plug connector part 100. FIG. 6 shows a cross-section of a receiving channel 113 in first housing 110. First plug connector part 100 is inserted a certain distance into second plug connector part 200, but is not completely connected to the second plug connector part. From the free end-face side of first plug connector part 100, a plug contact 500 with an attached connecting line 130 is inserted into receiving channel 113. However, plug contact 500 has not yet reached its intended installation position within first plug connector part 100.

Plug contact 500 is illustrated here as a push-on sleeve, for example. The push-on sleeve 500 may be manufactured as a one-piece stamped/bent part that forms a box-shaped sleeve body 502. A complementary pin-shaped plug contact (not shown), held by second plug connector part 200, may be inserted into sleeve body 502. A line connection section 503 to which connecting line 130 is fastened by crimping is connected in one piece to sleeve body 502.

It is apparent that sleeve body 502 of plug contact 500 is relatively extended in the radial direction compared to line connection section 503 and compared to a transition area 504 between sleeve body 502 and line connection section 503. Spring tongue 116, which is integrally formed onto second housing part 112 of first housing 110 of first plug connector part 100, has an integrally formed tab-like section 119. Tab-like section 119 of spring tongue 116 extends into receiving channel 113. A locking cam 115 is integrally formed onto the outer side of spring tongue 116.

Plug contact 500, which is not yet completely inserted into receiving channel 113, presses with its sleeve body 502 from the interior of first housing 110 of first plug connector part 100 against tab-like section 119 of spring tongue 116. The pressing of sleeve body 502 of plug contact 500 against tab-like section 119 of spring tongue 116 pushes spring tongue 116 out of its neutral position.

As a result, locking cam 115, formed on the outer side of spring tongue 116, rises above the level of outer surface 118 of first housing 110 of first plug connector part 100. It is apparent in FIG. 6 that locking cam 115 protruding from first housing 110 blocks further joining of plug connector parts 100 and 200.

FIG. 7 shows a plug contact 500 that is completely inserted into first housing 110 of first plug connector part 100. Plug contact 500 on its sleeve body 502 has a protruding elastic element, denoted as a lance 501. In the end position of plug contact 500, lance 501 engages with a projection 117 of receiving channel 113, thus providing primary securing of the plug contact 500 within receiving channel 113.

As also shown in FIG. 7, tab-like section 119 of spring tongue 116 is positioned above transition area 504 of plug contact 500 when plug contact 500 is completely inserted into receiving channel 113. Transition area 504 of plug contact 500 is relatively narrow in the radial direction compared to the remaining portions of plug contact 500. Tab-like section 119 thus finds sufficient room above plug contact 500, so that spring tongue 116 is not deflected from its neutral position here. The top side of locking cam 115 of spring tongue 116 is thus situated at the same level as an outer surface 118 of second housing part 112 of first housing 110 of first plug connector part 100, so that it no longer blocks joining of plug connector parts 100 and 200.

Spring tongues 116 with integrally formed tab-like sections 119, on the one hand, and with locking cams 115, on the other hand, thus prevent joining of plug connector parts 100 and 200 to form the connected first plug connector arrangement 800 as long as at least one plug contact 500 is not yet completely inserted into first plug connector part 100. It is advantageous, but not depicted in the illustration, to likewise provide a corresponding mechanism on second plug connector part 200.

As soon as plug connector parts 100 and 200 are joined together to form the connected first plug connector arrangement 800, inner wall 218 of second plug connector part 200 blocks the raising of locking cams 115 (not shown in detail here), and thus of spring tongues 116. As a result, only tab-like sections 119 on spring tongues 116 form secondary securing for plug contacts 500 inserted into receiving channels 113. For receiving channels 113 into which no plug contacts 500 have yet been inserted, tab-like sections 119 of spring tongues 116 prevent subsequent insertion of plug contacts 500 as soon as plug connector parts 100 and 200 are joined together.

Assembly of plug connector parts 100 and 200 may take place manually or automatically, depending on the particular need. The securing of housing parts 111 and 112 of first housing 110 of first plug connector part 100 and housing parts 211 and 212 of second housing 210 of second plug connector part 200 in their positions takes place due to form-fit and force-fit geometries. The use of adhesive points may be provided, additionally or alone, for securing the positions.

In the exemplary embodiment described above, the two plug connector parts 100 and 200, which are joinable to form plug connector arrangement 800, have housings 110 and 210, respectively. First housing 110 is made up of the two half shell-like housing parts 111 and 112 which are divided lengthwise in the insertion direction. Second housing 210 is made up of the two half shell-like housing parts 211 and 212 which are divided lengthwise in the insertion direction. This results in a structural longitudinal division in the middle of housings 110 and 210 which extends centrally along receiving channels 113 of the plug contacts.

Since receiving channels 113 thus are not formed until housing parts 111 and 112 are joined together and until housing parts 211 and 212 are joined together, and are not molded in advance as cavities in the housing parts, no slider geometries are required in the mold during production in an injection mold. This allows manufacture of housing parts 111 and 112 and housing parts 211 and 212 in injection molds having a particularly simple shape. Due to their relatively simple shape, housing parts 111 and 112 and housing parts 211 and 212 may also be manufactured with relatively short cycle times, and thus in a particularly cost-effective manner.

A second exemplary embodiment of a second multipole electric plug connector arrangement 900 is illustrated in FIGS. 8, 9, 10, and 11. Second plug connector arrangement 900 includes a first connector part 300 and a second connector part 400. As an example, plug connector parts 300 and 400 are 14-pole double-row plug connector parts. In this design, plug connector parts 300 and 400 are each made up of three housing parts instead of just two housing parts. Particularly, first plug connector part 300 includes housing parts 311, 3121, and 3122 and second plug connector part 400 includes housing parts 411, 4121, and 4122.

For first plug connector part 300, housing parts 3121 and 3122 are attached to middle housing part 311 from two sides, respectively. Housing parts 3121 and 3122 may be designed as identical parts which are cost-effective to manufacture. As such, also for second plug connector arrangement 900, for first plug connector part 300 it is necessary to provide injection molds for only two different housing parts.

For second plug connector part 400, housing parts 4121 and 4122 are attached to middle housing part 411 from two sides, respectively. Housing parts 4121 and 4122 may be designed as identical parts which are cost-effective to manufacture. As such, also for second plug connector arrangement 900, for second plug connector part 400 it is necessary to provide injection molds for only two different housing parts.

Figure 8:
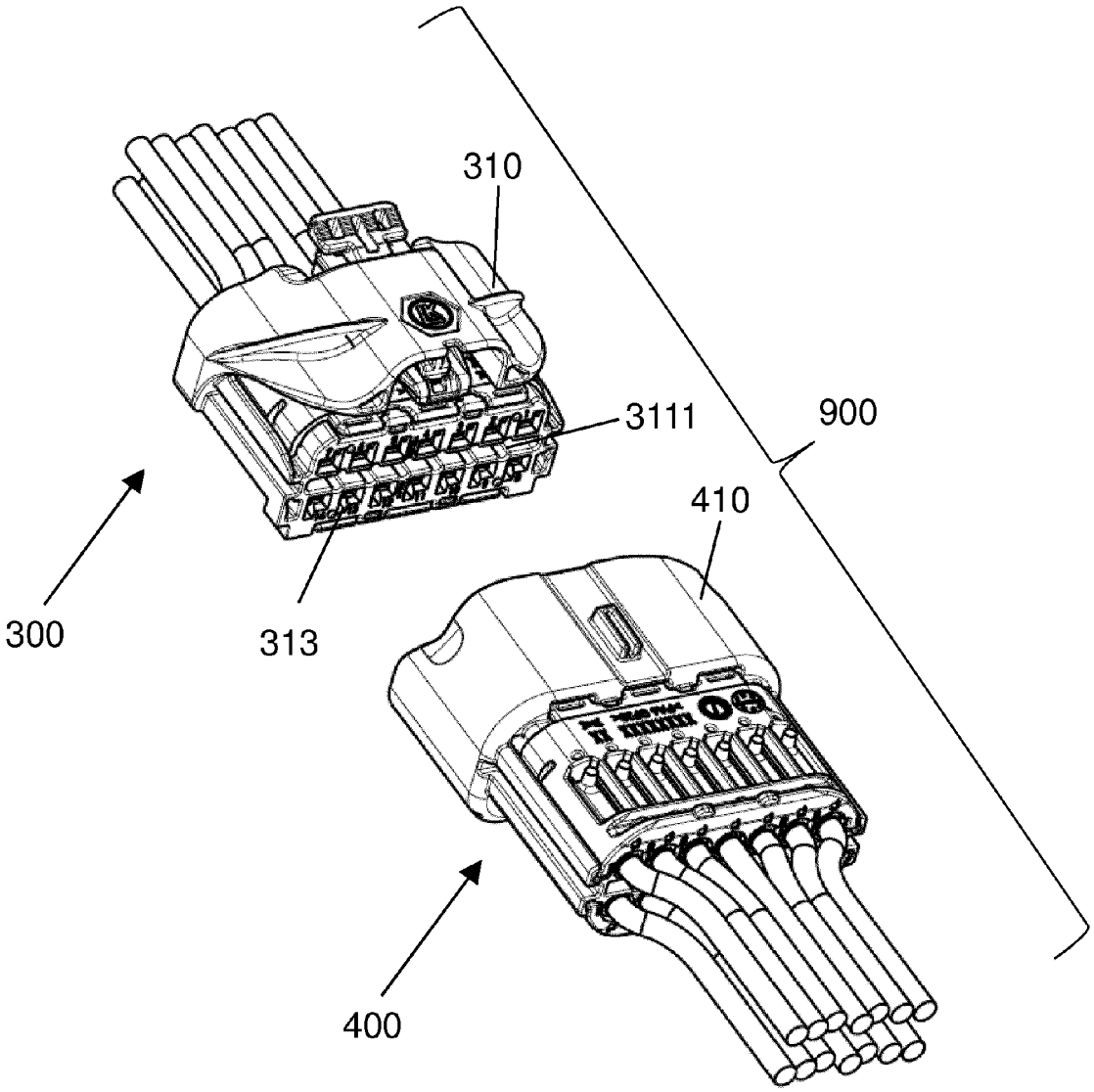
FIG. 8 illustrates a second multipole electric plug connector arrangement having a first multipole plug connector part and a second multipole plug connector part, the first and second plug connector parts being unconnected in FIG. 8.
Figure 9:
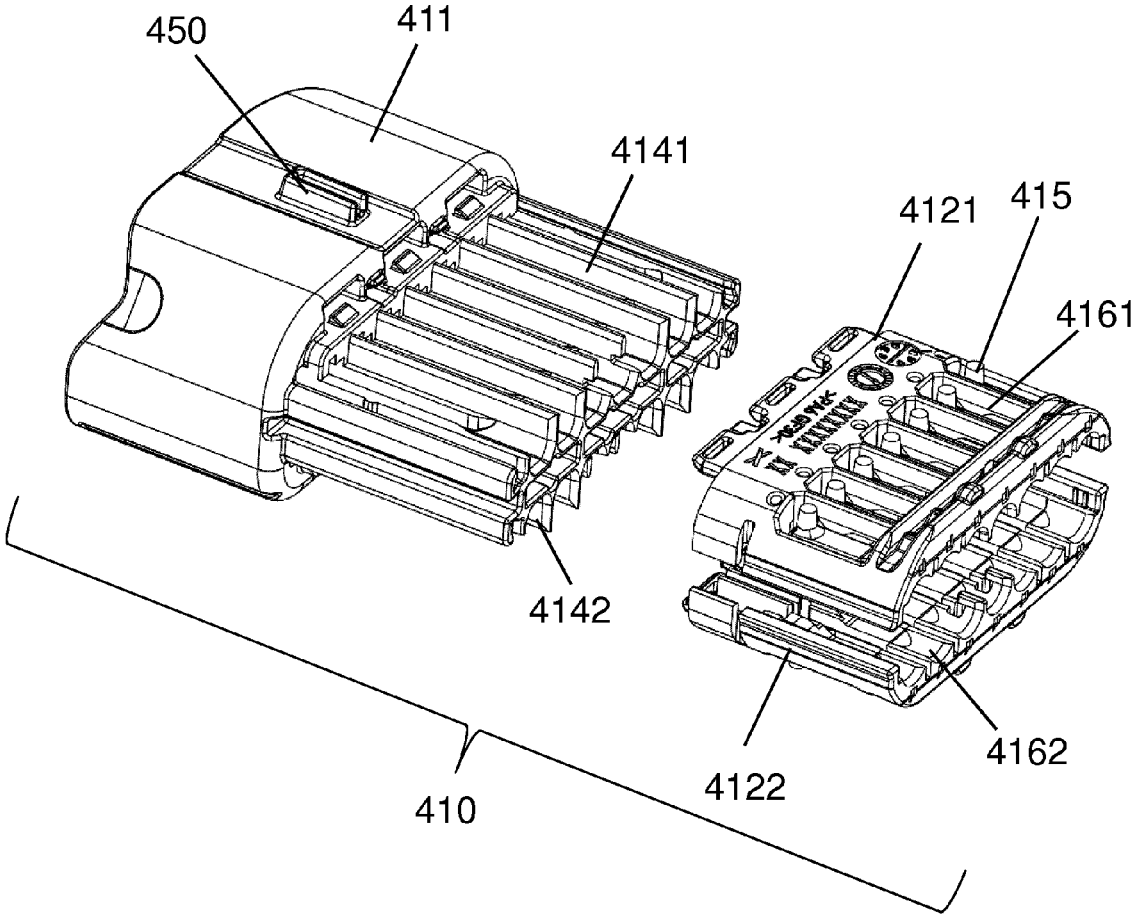
FIG. 9 illustrates the housing parts of the housing of the second plug connector part of the second plug connector arrangement.

Plug connector parts 300 and 400, which are illustrated in FIG. 8 as completely assembled, oppositely situated housing parts 311, 3121, and 3122 and housing parts 411, 4121, and 4122, and in FIGS. 9 and 10 as individual housing parts 311, 3121, 3122, 411, 4121, and 4122, implement the principle according to embodiments of the present invention that receiving channels 313 for receiving plug contacts do not result until two housing parts are joined together.

This is particularly apparent based on housing 410 illustrated in FIG. 9. Housing 410 results from joining two outer housing parts 4121 and 4122 to middle housing part 411. Middle housing part 411 on portions of its two main faces has integrally formed parallel grooves 4141 and 4142 whose open sides are on the outside. These grooves 4141 and 4142 may be closed and supplemented to form receiving channels by attaching the two outer housing parts 4121 and 4122. The walls of outer housing parts 4121 and 4122 have integrally formed spring tongues 4161 and 4162. Spring tongues 4161 and 4162 allow insertion of plug contacts into the pre-assembled housing 410 and thus bring about mechanical locking of the plug contacts in the receiving channels. Spring tongues 4161 and 4162 also have integrally formed locking cams 415 here which prevent joining of plug connector parts 300 and 400 in forming connected plug connector arrangement 900 if at least one plug contact has not yet been completely inserted into a receiving channel.

FIG. 10 illustrates the individual parts of housing 310 of first plug connector part 300, which is complementary to housing 410 of second plug connector part 400. For assembly of housing 310, two housing parts 3121 and 3122 are inserted into third housing part 311. An intermediate wall 3111 that is integrally formed inside housing part 311 supplements channels 3142 integrally formed in housing parts 3121 and 3122 to form receiving channels 313 for plug contacts 510, which are apparent in the sectional view in FIG. 11.

As also shown in FIG. 11, intermediate wall 3111 of housing 311 may form a cavity 3112 into which a solid, sword-shaped intermediate wall 4111 of housing 411 may be inserted. Cavity 3112 is thus used as a guide channel for sword-shaped intermediate wall 4111, which cooperates to assist in the joining of plug connector parts 300 and 400. After plug connector parts 300 and 400 are joined to form second plug connector arrangement 900, a CPA bar 350 situated on housing 310 secures the mechanical connection between plug connector parts 300 and 400.

Second plug connector arrangement 900 advantageously provides a relatively large number of connectable contacts in a comparatively compact space.

List of reference numerals

| | |
|---|---|
| 100, 200, 300, 400 | plug connector parts |
| 110, 210, 310, 410 | housings |
| 112, 211, 212, 311, 3121, 3122, 411, 4121, 4122 | housing parts |
| 3111, 4111 | intermediate walls (partitions) |
| 3112 | cavity (guide channel) |
| 113, 313 | receiving channels |
| 1141, 1142, 2141, 2142, 3142, 4141, 4142 | integrally formed parallel grooves |
| 115, 415 | locking cams |
| 116, 216, 3161, 3162, 4161, 4162 | spring tongues (spring arms) |
| 117 | projections |
| 118 | outer surface |
| 218 | inner wall |
| 119 | sections |
| 121, 122, 221, 222 | webs |
| 123, 223 | molded-in grooves |
| 124, 224 | springs |
| 130, 230 | connecting lines |
| 141, 142, 241, 242 | hook connecting elements (hook fasteners) |
| 150, 350 | CPA bar |
| 250, 450 | projection |
| 160 | detent arm |
| 161, 162 | detent connecting elements (latches) |
| 500, 510 | plug contact elements (plug contacts), push-on sleeve |
| 501 | elastic element (lance) |
| 502 | sleeve body |
| 503 | line connection section |
| 504 | transition area |
| 800, 900 | plug connector arrangement |

While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A plug connector part, comprising:

a housing having a first housing part and a second housing part, wherein the housing parts are joined together parallel to a plug contact insertion direction, the housing parts have lateral surfaces which face one another, the housing parts have integrally formed parallel grooves at their lateral surfaces, the grooves form parallel receiving channels when the housing parts are joined together, the receiving channels are to receive plug contacts, each receiving channel includes a projection;

a plurality of plug contacts having integrally formed lances, wherein the lances engage the projections of the receiving channels when the plug contacts are received at a fully installed position within the receiving channels; and wherein the first housing part includes elastic spring tongues along the grooves of the first housing part, the spring tongues are biased in a neutral position and are deflectable to a deflected position, the spring tongues are in the neutral position when the plug contacts are received at the fully installed position within the receiving channels and are deflected by the plug contacts into the deflected position when the plug contacts are received at a partially installed position within the receiving channels;

the spring tongues have tab-like sections which extend into the receiving channels to fix the plug contacts within the receiving channels in a form-fit manner when the plug contacts are received at the fully installed position within the receiving channels and to engage the plug contacts to enable the plug contacts to deflect the spring tongues into the deflected position when the plug contacts are received at the partially installed position within the receiving channels;

the spring tongues further have integrally formed locking cams which are within an outer surface of the first housing part while the spring tongues are in the neutral position with the plug contacts being received at the fully installed position within the receiving channels and extend beyond the outer surface of the first housing part while the spring tongues are in the deflected position with the plug contacts being received at the partially installed position within the receiving channels.

2. The plug connector part of claim 1 wherein:

the first housing part and the second housing part are detachably connected to one another by at least one of hooks and latches.

3. A plug connector assembly comprising:

a first plug connector part;

a second plug connector part joinable with the first plug connector part;

wherein each plug connector part has a housing having a first housing part and a second housing part, wherein the housing parts of each plug connector part are joined together parallel to a plug contact insertion direction, have lateral surfaces which face one another, and have integrally formed parallel grooves at their lateral surfaces, wherein the grooves form parallel receiving channels when the housing parts are joined together, the receiving channels are to receive plug contacts, each receiving channel includes a projection;

a plurality of plug contacts having integrally formed lances, wherein the lances engage the projections of the receiving channels when the plug contacts are at a fully installed position within the receiving channels; and wherein the first housing part of the first plug connector part includes elastic spring tongues along the grooves of the first housing part, the spring tongues are biased in a neutral position and are deflectable to a deflected position, the spring tongues are in the neutral position when the plug contacts are received at the fully installed position within the receiving channels and are deflected by the plug contacts into the deflected position when the plug contacts are received at a partially installed position within the receiving channels;

the spring tongues have tab-like sections which extend into the receiving channels to fix the plug contacts within the receiving channels in a form-fit manner when the plug contacts are received at the fully installed position within the receiving channels and to engage the plug contacts to enable the plug contacts to deflect the spring tongues into the deflected position when the plug contacts are received at the partially installed position within the receiving channels;

wherein while the first plug connector part and the second plug connector part are being joined with one another while the plug contacts are received at the partially installed position within the receiving channels, the spring tongues in the deflected position contact the second plug connector part to block further joining of the first plug connector part and the second plug connector part.

4. The plug connector assembly of claim 3 wherein:

after the first plug connector part and the second plug connector part are completely joined, deflection of the locking tabs of the spring tongues of the first plug connector part beyond the outer surface of the first housing part of the first plug connector part is blocked by the first housing part of the second plug connector part.

5. The plug connector assembly of claim 3 further comprising:

a connector position assurance bar for securing a mechanical connection between the first plug connector part and the second plug connector part.

6. The plug connector assembly of claim 3 wherein:

the first housing part and the second housing part of each plug connector part are detachably connected to one another by at least one of hooks and latches.

* * * * *